US005232313A

United States Patent [19]

Jennings et al.

[11] Patent Number: 5,232,313

[45] Date of Patent: Aug. 3, 1993

[54] SHORING GUARD

[76] Inventors: Charles B. Jennings, 8951 W. Windsor, Phoenix, Ariz. 85037; Gregory L. George, 2371 W. Waltann La., Phoenix, Ariz. 85023; Karen L. Martin, 16607 S. 36th St., Phoenix, Ariz. 85044

[21] Appl. No.: 958,491

[22] Filed: Oct. 8, 1992

[51] Int. Cl.[5] ..... E02D 17/04

[52] U.S. Cl. ..... 405/283; 405/282

[58] Field of Search ..... 405/282, 283, 211, 303, 405/281; 137/377, 381, 371, 294, 296; 49/383; 56/256

[56] References Cited

U.S. PATENT DOCUMENTS

| | | | |
|---|---|---|---|
| 1,078,700 | 11/1913 | Schodde | 137/377 X |
| 2,118,233 | 5/1938 | Ruggio | 137/296 |
| 3,734,238 | 2/1956 | Clapp | 49/383 X |
| 3,791,151 | 2/1974 | Plank | 405/282 |
| 3,969,877 | 7/1976 | Moss et al. | 56/256 |
| 4,267,674 | 5/1981 | Muller | 137/377 X |
| 4,787,781 | 11/1988 | Bradberry | 405/282 |

FOREIGN PATENT DOCUMENTS

| | | | |
|---|---|---|---|
| 0106018 | 6/1983 | Japan | 405/283 |
| 0073914 | 4/1985 | Japan | 405/282 |

*Primary Examiner*—Dennis L. Taylor
*Attorney, Agent, or Firm*—Gregory J. Nelson

[57] ABSTRACT

A finger guard for attachment to a shoring device made from a flexible material. The guard has a shield to protect the user's fingers and is held in place by a removable hinge pin which inserts into the shoring device.

8 Claims, 1 Drawing Sheet

SHORING GUARD

The present invention relates to a safety device and more particularly to a safety guard attachable to shoring devices to protect the hands and fingers of workmen from being pinched or caught in a shoring device when it is being assembled, folded or collapsed.

Sound excavation safety practice and OSHA standards for safe trenching require that the side walls of trenches be supported or shored against collapse. The particular shoring requirements vary considerably with soil composition and trench size. Generally when excavating in stable soils, state and federal regulations require the trenches having a depth greater than approximately four to five feet be vertically shored to avoid exposing workers to the hazards of unshored trenches. Shoring devices generally utilize vertical support members which are held in place against the opposite trench walls by extendable hydraulic actuator devices. Typical of this type of shoring device are those manufactured and offered for sale by Safe-T-Shore of Tempe, Ariz. under the designation "Safe-T-Shore Shoring Devices".

Shoring devices of the general type have found wide acceptance and have minimized the hazards of excavation. Devices of the foregoing type are simple and effective and can be easily put in place. Generally the devices include opposite trench-engaging panels which are connected to hydraulic actuators at blocks pivotally secured to rails or walers. Insetting up such devices, the workman lowers the shoring device into the trench causing it to unfold. The hydraulic actuators are pressurized, usually using a portable source of hydraulic pressure such as a hand pump. The opposite walers or rails directly engage the side walls or are attached to panels which support the excavation.

When it is desired to remove the shoring device, hydraulic pressure is relieved and the shoring device is pulled from the trench using a suitable tool or rope. The shoring device may then be collapsed or folded to a position with the rails or walers assuming a position adjacent one another which collapsibility is permitted by the pivotal attachment of the opposite ends of the actuators to mounting blocks on the shoring device. A particular safety problem is that the mounting blocks are usually located between flanges extending from the rails or walers. When the shoring device is collapsed, the mounting block pivots and the worker in lifting or grasping the shore may inadvertently cause a finger to be pinched between the block and the rail due to the scissor action of the components.

In order to protect workers, some shoring devices are equipped with a finger guard which is associated with the mounting blocks. However, these finger guards, while providing some degree of protection are not easily retrofitable to existing shoring devices. Further, prior art finger guards generally mount between the rails of the waler and may impede or interfere with the smooth folding operation of the mounting blocks.

Accordingly, it is a primary object of the present invention to provide an improved finger guard device for shoring devices which is safe, simple and easily attachable to a shoring device.

Briefly, the present invention provides a finger guard for attachment to the rails of a shoring device at flanges at opposite sides of the mounting block. The safety device is fabricated from a flexible material such as a vinyl plastic and has an upstanding shield which abuts the exterior of the flange or rails associated with the waler at opposite sides of the mounting block. The guard has a base which engages the surface of the rail. The upstanding shield is provided with one or more apertures which align with apertures in the flange and mounting block so the safety guard may be held in place by the hinge pin permitting the guard to be easily installed on existing shoring devices.

The above and other objects and advantages of the present invention will become apparent from the following description, claims and drawings in which:

Figure 1:
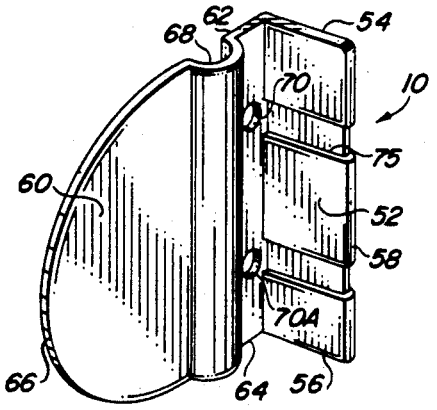
FIG. 1 is a perspective view of the safety guard of the present invention.

Turning to the drawings, a preferred embodiment of the shoring safety device is shown. The guard of the present invention is generally designated by the numeral 10 and is shown in conjunction with a hydraulic shoring device 12. The purpose of the shoring device is to support the opposite side walls of a trench to reduce to possibility of collapse of the side wall during construction activities. In some soils, particularly the more unstable soils, shoring devices are used which have substantially continuous sheeting or walls which engage the trench walls. The shoring device 12 is representative and generally consists of opposed longitudinally extending walers 14 and 14A which are interconnected by extendable and retractable actuator assemblies 20 and 22. The walers consist of a beam structure as shown, each having a generally flat face 25 which engages the trench walls. A pair of flanges or rails 28 and 30 project from the interior side of the waler terminating at a lip or bead 32. The flanges extend longitudinally along the waler.

The opposite ends of the actuator assembly 20 are shown secured to a mounting block 36 which is positioned between the flanges or rails 28 and 30. As shown, the actuator assembly threadably engages the block 36 at 39. Block 36 is further provided with suitable coupling 38 with a quick connect fitting for convenient attachment to a source of hydraulic fluid. The blocks 36 include one or more transverse bores, not shown, which may be positionable aligned with transverse bores in the rails or flanges. The hinge connection is completed by a removable pin 42 which is inserted between the rails 28, 30 and through the block 36. A retaining ring 44 is shown secured to the projecting end of the hinge pin to prevent it from becoming inadvertently disengaged from the mounting block.

Figure 2:
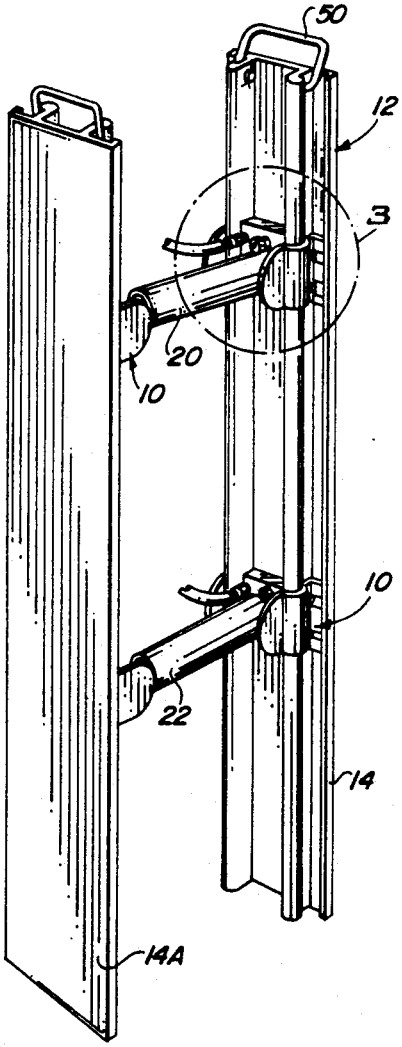
FIG. 2 is a perspective view of a typical shoring device shown in an extended position with safety guards in accordance with the present invention mounted thereon.
Figure 4:
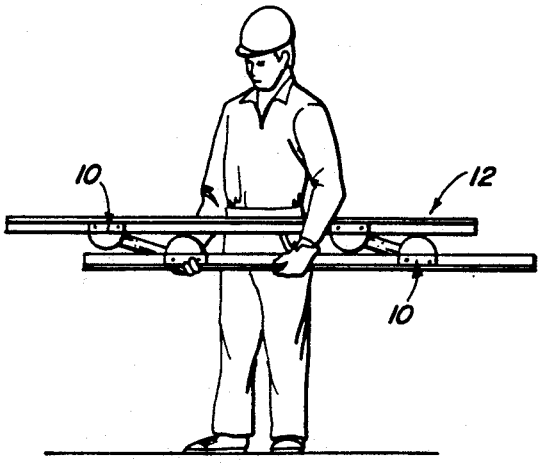
FIG. 4 illustrates a workman holding a shoring device in a collapsed position with the finger guards protecting the hands and fingers of the worker.

FIG. 2 shows the formal operating position of the shoring device. The shoring device 12 is inserted into the trench, as for example in a vertical position as shown, using handle or grips 50 at the upper end of the walers. Once in position, the fitting 38 is connected to a source of hydraulic fluid and the actuators extended to bring the opposite walers firmly into engagement with the trench walls. When it is desired to remove the shoring device, the actuators are relieved of hydraulic pressure and the actuators are allowed to collapse. The shoring devices may then be manually lifted from the trench. For convenience of transportation and storage, the hinged or pivotal connection between the mounting blocks and rails allow the shoring device to collapse to a position as shown in FIG. 4. In the collapsed position, the opposite rails assume a position generally adjacent one another as shown with the actuators assuming an angular position as shown in FIG. 4 If a workman is not careful, the workman may injure a hand or finger when the shore is collapsed as the hand or finger may be pinched between the waler and the pivoting mounting block. The area where this is most likely to occur is the area within the dashed circle in FIG. 2.

To minimize this possibility, the guard 10 of the present invention may be easily secured to the shoring device to keep the worker's fingers away from the area of the mounting blocks. The general description of the shoring device above is to facilitate an understanding of the invention. The particular shoring device forms no part of the present invention, it being understood that the finger guard of the invention may be used with variously constructed shoring devices of the general type.

The finger guard 10 is preferably fabricated from a tough, resilient material such as a polyvinyl or polyurethane. Resilient material is preferable as such material will better absorb the impacts to which equipment of this type is subjected without damage.

Figure 3:
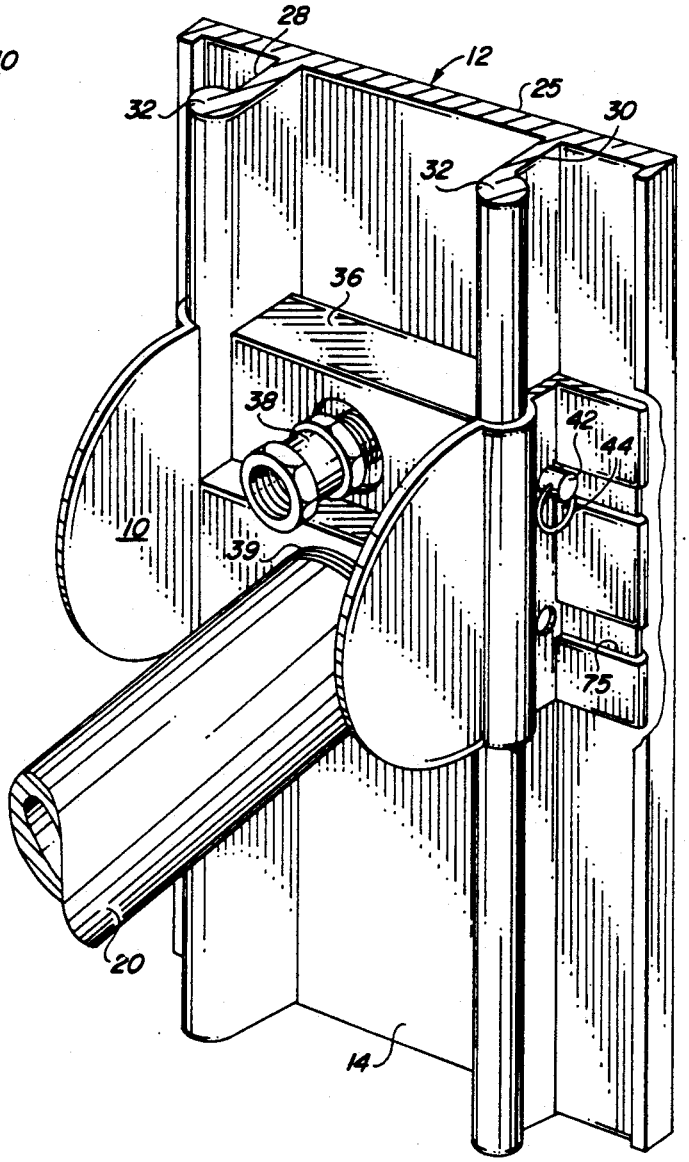
FIG. 3 is an enlarged view of a portion of the shoring device and safety guards as indicated in FIG. 2.

The guard is a unitary device which is generally L-shaped in cross section having a base 52 which has opposite ends 54 and 56 and longitudinally extending outer edge 58. An upstanding shield 60 is integrally formed with the base having opposite sides 62 and 64 interconnected by a top edge 66 which is shown as being generally semi-circular. A groove or recess 68 is formed in the shield 60 extending longitudinally in the surface of the shield. The groove or recess is configured to receive the lip 32 of the waler as best shown in FIG. 3. The base 50 of the shield abuts the interior surface of the waler extending generally from the base of the flange to the outer edge of the rail. The overall longitudinal dimension of the shield preferably exceeds the corresponding longitudinal dimension of the mounting block 36. The shield portion has an overall height which is selected to at least correspond to the position of the mounting block when the shore is in a folded position, as shown in FIG. 4. Thus, in all positions of the mounting block, either in the assembled or collapsed position, the guard will shield the mounting block so the workman's hands and fingers will be protected.

As shown in FIG. 3, guards 10 are disposed on the rails or flanges at opposite sides of the mounting block and are easily attached to existing shoring devices. The guards are held in place at the outer side of the rail by extending the hinge pin through bores 70–70A provided in the shield. After the pins are in place, the retaining rings 44 may be inserted through the ned of the pin. Preferably, a pair of spaced-apart bores are provided in the shield as shown so that the guards are reversibly positioned at either of the rails. Transversely extending channels 75 extend in the base aligned with the bores to provide increased clearance for the hinge pin.

Thus, it will be seen the present invention provides a safety device which is simple, efficient and easily secured to shoring devices. It will be obvious to those skilled in the art that various changes, alterations and modifications may be made to the safety guard described herein. The configuration may vary somewhat to conform to the physical configurations of the various shoring devices. To the extent these changes, alterations and modifications do not depart from the spirit and scope of the appended claims, they are intended to be encompassed therein.

I claim:

1. A safety guard detachably securable to a shoring device of the type having a pair of opposed beams having outer and inner surfaces, said outer surface engageable against excavation surfaces and with extendable and retractable actuators pivotally secured at the inner beam surfaces at pivotal mounting blocks, said guard comprising:

(a) a body having a base and a shield extending from said base, said base and shield configured so that the shield extends adjacent said mounting block with the base abutting the inner surface of said beam; and (b) means for detachably securing said body to said beam.

2. The safety guard of claim 1 wherein said body is fabricated from a resilient material.

3. The safety guard of claim 1 wherein said body is a plastic material.

4. The safety guard of claim 1 wherein said shield has a generally curved outer edge.

5. The safety guard of claim 1 wherein said means for detachably securing said body to said beam comprises holes defined in said body at spaced-apart locations.

6. A safety guard detachably securable to a shoring device of the type having a pair of opposed beams having outer and inner surfaces, said outer surfaces engageable against excavation surfaces and having an extendable and retractable actuator pivotally secured at blocks at the inner surface of said beams, said blocks defining a transverse bore and for receiving a removable pin extending between spaced-apart flanges at said inner surface, said guard comprising:

(a) a unitary body of a resilient material having a base and a shield extending generally perpendicular with respect to the base and the beam, said shield having a generally curved outer edge projecting rearwardly past the associated flange; and (b) said body defining holes at spaced-apart locations to align with said apertures to be retained by said pin.

7. The safety guard of claim 6 wherein said body defines a groove extending in said shield to receive a portion of the flange.

8. The safety guard of claim 6 wherein said base defines channel means aligned with said bores.

* * * * *